US006714096B1

(12) United States Patent
Broad et al.

(10) Patent No.: US 6,714,096 B1
(45) Date of Patent: Mar. 30, 2004

(54) WAVEGUIDE DIRECTIONAL FILTER

(75) Inventors: Graham J. Broad, Lilydale (AU); Noel A. McDonald, Croydon (AU); Charles Williams, Ferntree Gully (AU)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/857,104

(22) PCT Filed: Dec. 6, 1999

(86) PCT No.: PCT/AU99/01071

§ 371 (c)(1),
(2), (4) Date: Sep. 18, 2001

(87) PCT Pub. No.: WO00/35043

PCT Pub. Date: Jun. 15, 2000

(30) Foreign Application Priority Data

Dec. 4, 1998 (AU) ..... PP 7470

(51) Int. Cl.[7] ..... H01P 5/00
(52) U.S. Cl. ..... 333/110; 333/135; 333/21 R
(58) Field of Search ..... 333/110, 135, 333/21 R, 111, 126, 113, 114, 108, 122, 137

(56) References Cited

U.S. PATENT DOCUMENTS 2,939,093 A * 5/1960 Marie ..... 333/110
2,999,988 A * 9/1961 Marie ..... 333/110
3,845,415 A * 10/1974 Ando ..... 333/135
4,327,330 A * 4/1982 Ranghelli ..... 330/56
4,777,459 A * 10/1988 Hudspeth ..... 333/135

OTHER PUBLICATIONS

Y. Isota et al, "Broadband Cylindrical–Cavity Directional Filter", Electronics & Communications in Japan, Part I—Communications, NY, US, vol. 76, No. 6, Jun. 1, 1993 pp. 85–90 XP000425135.

R. C. Johnson and H. Jasik, "Antenna Engineering Handbook" 1984, NY XP002201459, pp. 42–32.

* cited by examiner

*Primary Examiner*—Robert Pascal
*Assistant Examiner*—Dean Takaoka

(57) ABSTRACT

A waveguide directional filter is described for combining multiple high power UHF television broadcasting transmitters on to a common antenna. The filter arrangement comprises an input waveguide (1) and an output waveguide (2). The waveguides are rectangular having broad walls (3) joined by narrow walls (4) whose width/height ratio is approximately 4:1. The two waveguides are connected by at least one direct-coupled cavity resonator (5). Coupling between the cavity and each waveguide is obtained by a respective characteristic aperture (7, 7*a*) in the form of a rectangle whose four sides have inwardly extending hemicycle sectors (8, 9, 10 and 11).

9 Claims, 7 Drawing Sheets

WAVEGUIDE DIRECTIONAL FILTER

FIELD OF INVENTION

This invention relates to the technology of combining multiple UHF TV broadcasting transmitters on to a common antenna.

BACKGROUND OF INVENTION

In this technology it is known to provide a UHF filter/combiner system comprising an assembly of dual bandpass filters whose inputs and outputs are coupled by waveguide hybrid couplers. A disadvantage of this known system is its relatively large size. Another disadvantage of this system is that the dual bandpass filters must be electrically identical, which is difficult to accomplish due to their complexity.

It is also known to provide a UHF filter/combiner that comprises a cascade of dual mode resonant cavities with input and output coaxial coupling elements, such as the "ROTAMODE" device. However, a disadvantage of this form of construction is that the power handling capability of the coaxial input and output elements is limited.

It is also known to use a waveguide directional filter technique at microwave multi-point distribution system (MMDS) frequencies above 2 GHz. Each TV channel at MMDS frequencies occupies a fractional bandwidth of much less than 1%. However, at UHF broadcasting frequencies in the range 470–860 MHz, the fractional bandwidth of a TV channel is of the order of 1% or more, and a conventional waveguide directional filter does not provide a satisfactory electrical performance.

SUMMARY OF THE INVENTION

It is an object of the present invention to provide a waveguide directional filter arrangement which can be used at UHF broadcasting frequencies, and avoids the disadvantages of the aforementioned prior art.

According to a first aspect of the invention there is provided a waveguide directional filter arrangement comprising an input waveguide means and an output waveguide means connected by cavity resonator means, wherein said input waveguide means and said output waveguide means each include broad wall sections joined by narrow wall sections whose aspect ratio is greater than 2:1.

According to a second aspect of the invention there is provided a waveguide directional filter arrangement comprising an input waveguide means and an output waveguide means, wherein each said waveguide means includes an aperture means arranged to couple its associated waveguide means to a common resonator means, and wherein edges of each aperture means include inwardly extending sections.

According to a third aspect of the invention there is provided a waveguide directional filter arrangement comprising an input waveguide means and an output waveguide means connected by cavity resonator means comprising at least three stacked resonator elements, wherein at least one pair of non-adjacent resonator elements include additional coupling means to couple the non-adjacent resonator elements.

According to a fourth aspect of the invention there is provided a waveguide directional filter arrangement comprising an input waveguide means and an output waveguide means connected by a cavity resonator means comprising at least one resonator element, said input waveguide means and said output waveguide means each include broad wall sections joined by narrow wall sections whose aspect ratio is greater than 2:1, each said waveguide means includes an aperture means arranged to couple its associated waveguide means to said cavity resonator means, wherein edges of each aperture means include inwardly extending sections.

In highly selective bandpass filters which use adjacent cavity resonators coupled by apertures in common walls, the magnitudes of such couplings are very critical parameters.

In order to achieve these necessary critical parameters it is known to provide a high degree of manufacturing precision. However, this solution is unattractive for large filters.

It is therefore a further object of the present invention to provide an adjustable coupling aperture arrangement for adjusting the coupling of cavity resonators over a wide range of coupling values, the coupling being adjusted externally using a tool that does not disturb the filter's characteristics.

According to a fifth aspect of the invention, in a microwave filter comprising a housing within which is disposed at least two cavity resonators coupled by aperture means in a substantially planar wall common to both said resonators, there is provided an adjustable coupling aperture arrangement including aperture means comprising at least one slit of predetermined dimensions, the at least one slit communicating with a respective access hole in said housing via an associated passageway that lies within the boundary of said wall's major surfaces, wherein said at least one slit is provided with a moveable metal slug that is slideably retained by opposite longitudinal edges of the slit, whereby said slug can be engaged and slideably manipulated by a tool means, introduced into said access hole and guided to said slug via said passageway, into a position in which electrical contact between said slug and said edges of the slit produces a desired change in effective electrical length of the slit.

BRIEF DESCRIPTION OF THE DRAWINGS

In order that the invention may be readily carried into effect, embodiments thereof will now be described in relation to the accompanying drawings, in which.

DETAILED DESCRIPTION

Figure 1:
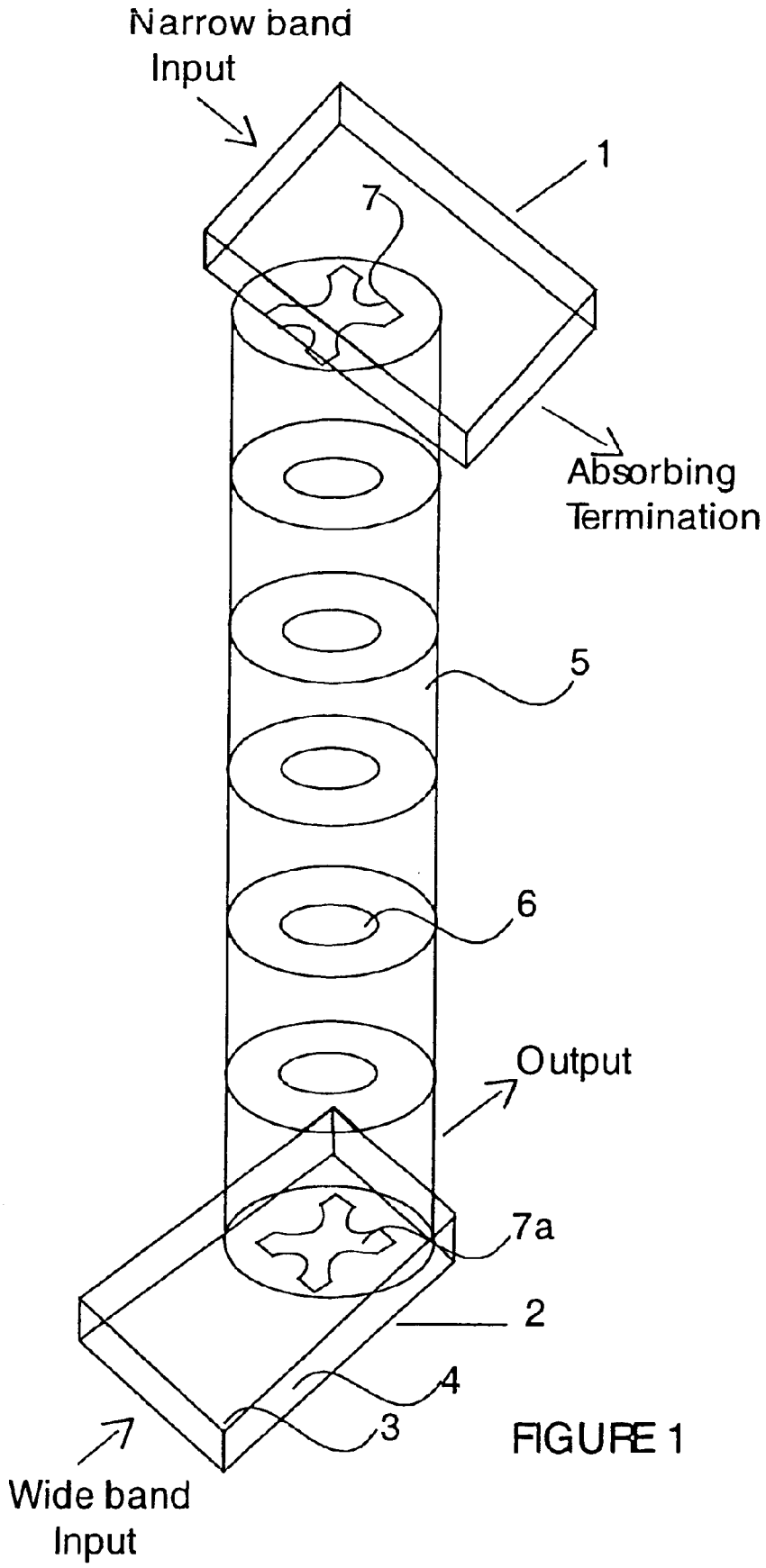
FIG. 1 shows a waveguide directional filter assembly of the present invention.

Referring to FIG. 1, the assembly comprises an input waveguide 1 having a narrow band input port and an absorbing termination port; and an output waveguide 2 having a wideband input port and an output port. The waveguides are rectangular having broad walls 3 joined to narrow walls 4 whose aspect ratio is approximately 4:1.

Waveguides 1 and 2 are connected by six circularly cylindrical aperture coupled cavities 5. Coupling between adjacent cavities is provided by circular apertures 6.

Figure 2:
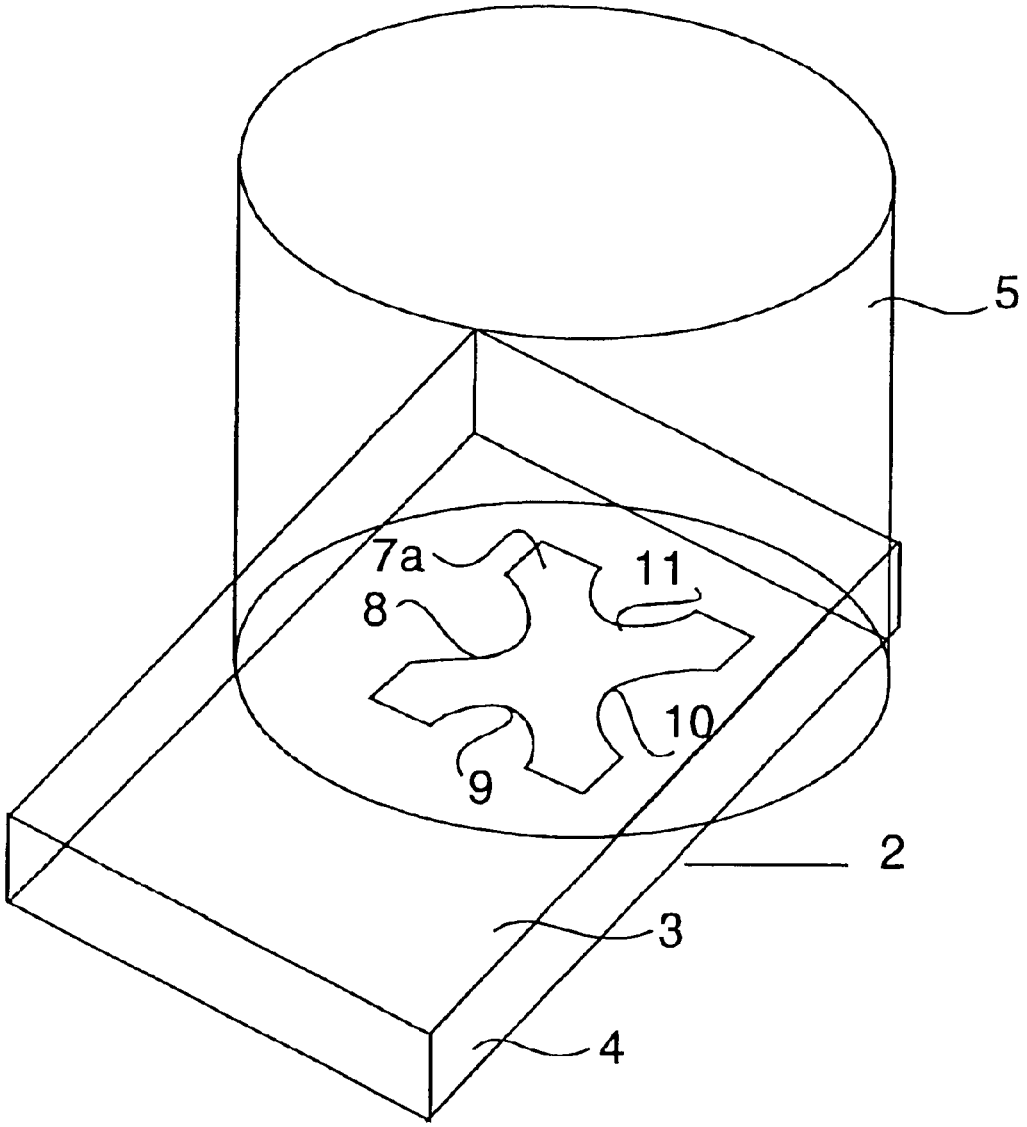
FIG. 2 shows a more detailed view of the aperture arrangement of the assembly shown in FIG. 1.

Each end cavity is operatively coupled to its associated rectangular waveguide through a characteristically shaped aperture 7, 7*a*. Referring to FIG. 2, aperture 7*a*, which is similar to aperture 7 in input waveguide 1, is in the form of a rectangle whose four sides have integral inwardly extending hemicycle sectors 8, 9, 10 and 11. These hemicycle sections provide increased coupling into the desired resonator mode.

It will be understood that the inwardly extending hemicycle sections can be in the form of discrete elements, such as for example discs, that can be attached around the edges of a basic rectangular aperture. The position of such discrete elements can be made adjustable to vary the coupling through the aperture.

Figure 3:
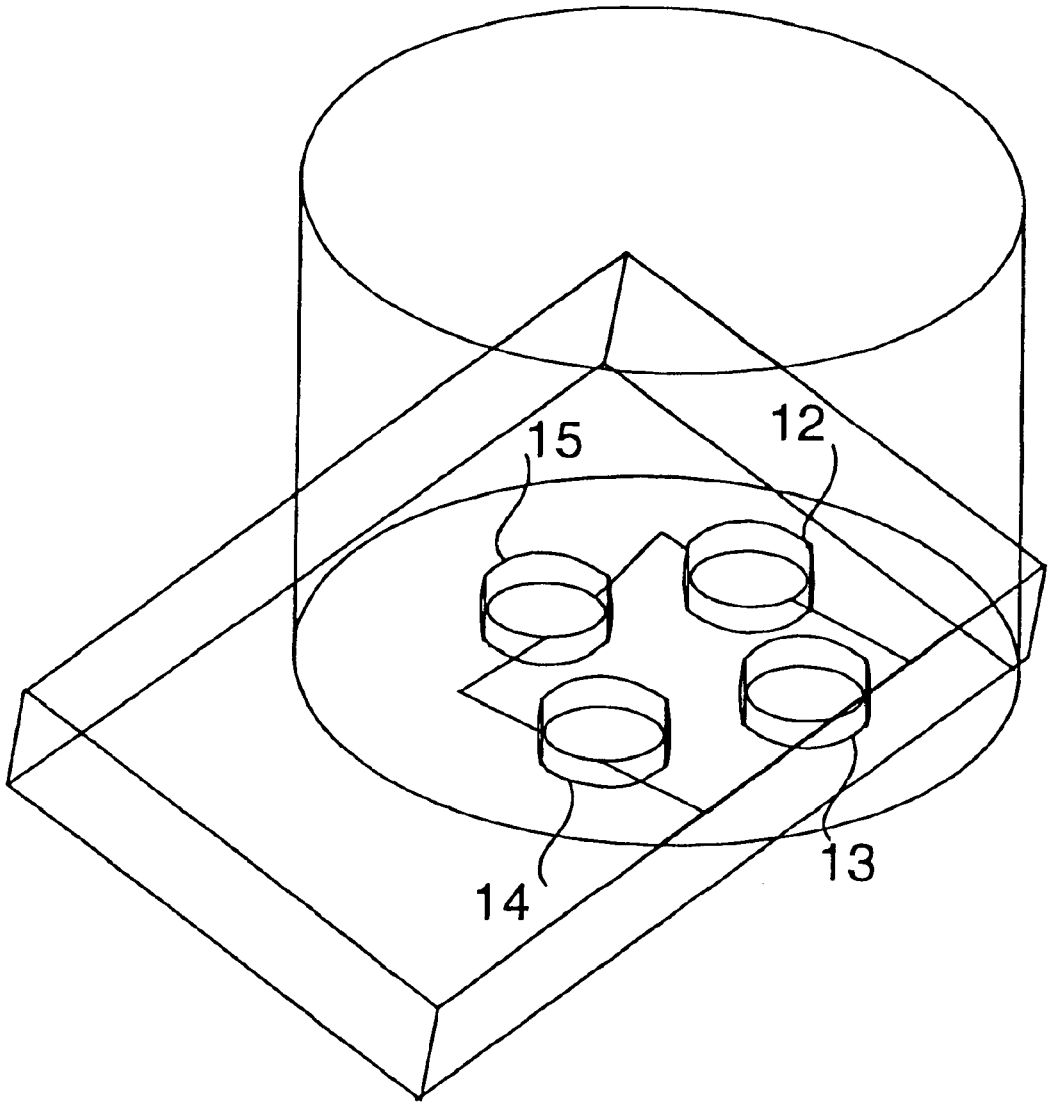
FIG. 3 shows an alternative aperture arrangement.

Alternatively, the inwardly extending hemicycle sections can be in the form of cylinders 12, 13, 14 and 15 as shown in FIG. 3. As with the above mentioned discs, the position of the cylinders can be adjustable to vary the coupling through the aperture. Moreover, the cylindrical form causes a greater reduction of coupling into undesirable modes.

Figure 4:
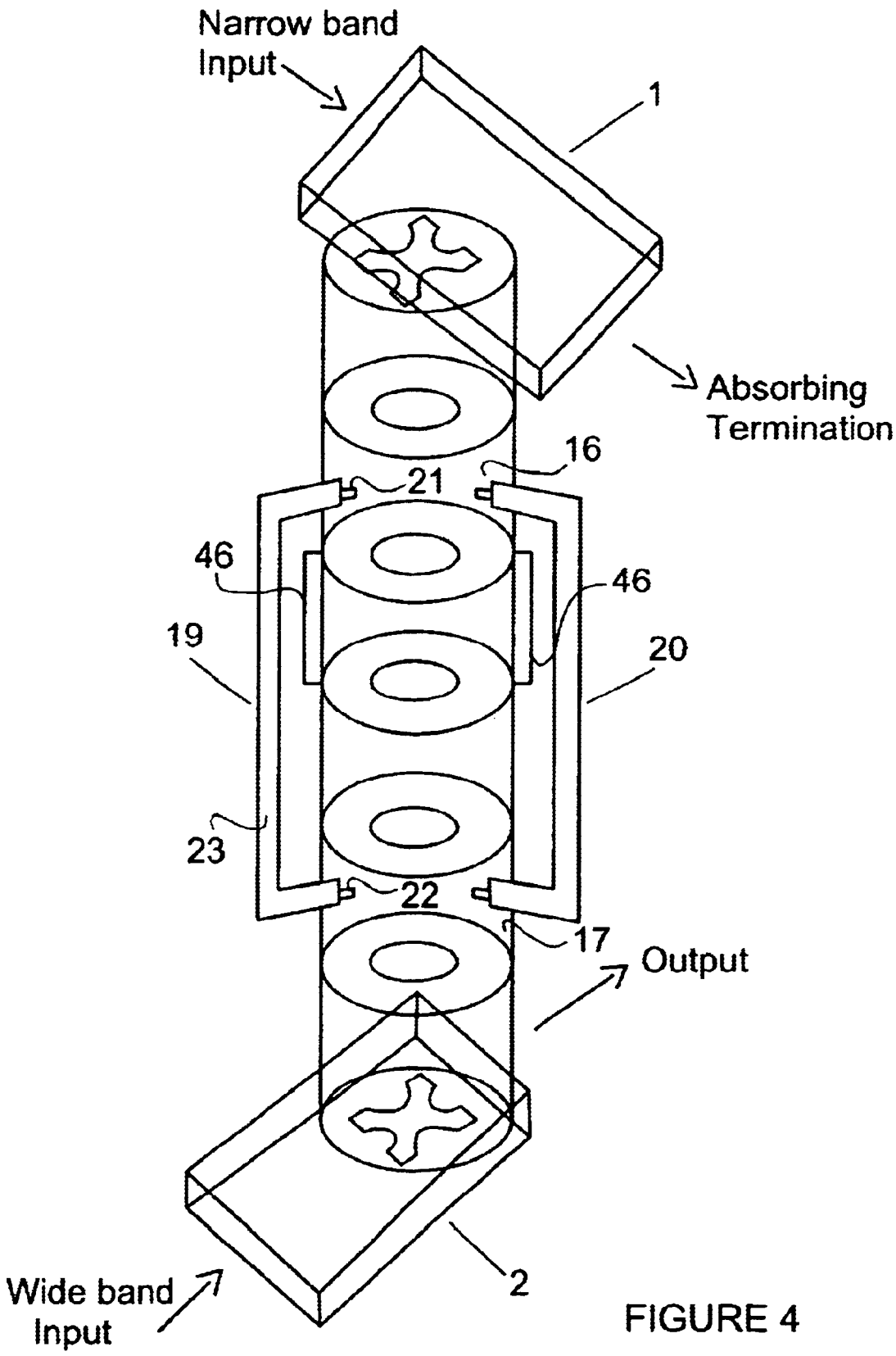
FIG. 4 shows a waveguide direction filter assembly with additional coupling between non-adjacent resonators.

Referring to FIG. 4, non-adjacent resonator elements 16 and 17 of the waveguide directional filter assembly are provided with two additional coupling elements 19 and 20. Each coupling element comprises two probes 21 and 22 connected by a transmission line 23. The probes extend into the resonators and are disposed at 90° to one another.

The power handling capability of the waveguide directional filter arrangement described above can be enhanced by the addition of cooling fins 46 on one or more of the cavity resonators.

Also, tuning elements (not shown) can be added to the cavity resonators.

In operation, a narrow band signal is injected into the input port of input waveguide 1. This signal is coupled through aperture 7 into the first cavity resonator and launches a circularly polarised wave therein which is coupled through successive circularly cylindrical resonators 5 by means of circular apertures 6 to the output waveguide 2 via aperture 7*a*, where it produces a directional wave. This signal is added to any existing signals travelling through the same waveguide at other frequencies.

An absorbing termination coupled to waveguide 1 absorbs any power not coupled into the first resonator.

The reduced height of the waveguides improves the circularity of the circularly polarised wave in the resonators, which provides improved directional characteristics in the output waveguide across the operational band.

An advantage of the waveguide directional filter assembly of the present invention vis-a-vis the prior art assembly using separate hybrids and filters is that the assembly of the present invention is relatively unaffected by temperature differentials which can occur between separate filters in a hybrid coupled configuration. Such temperature differentials lead to a degradation of performance.

Figure 5:
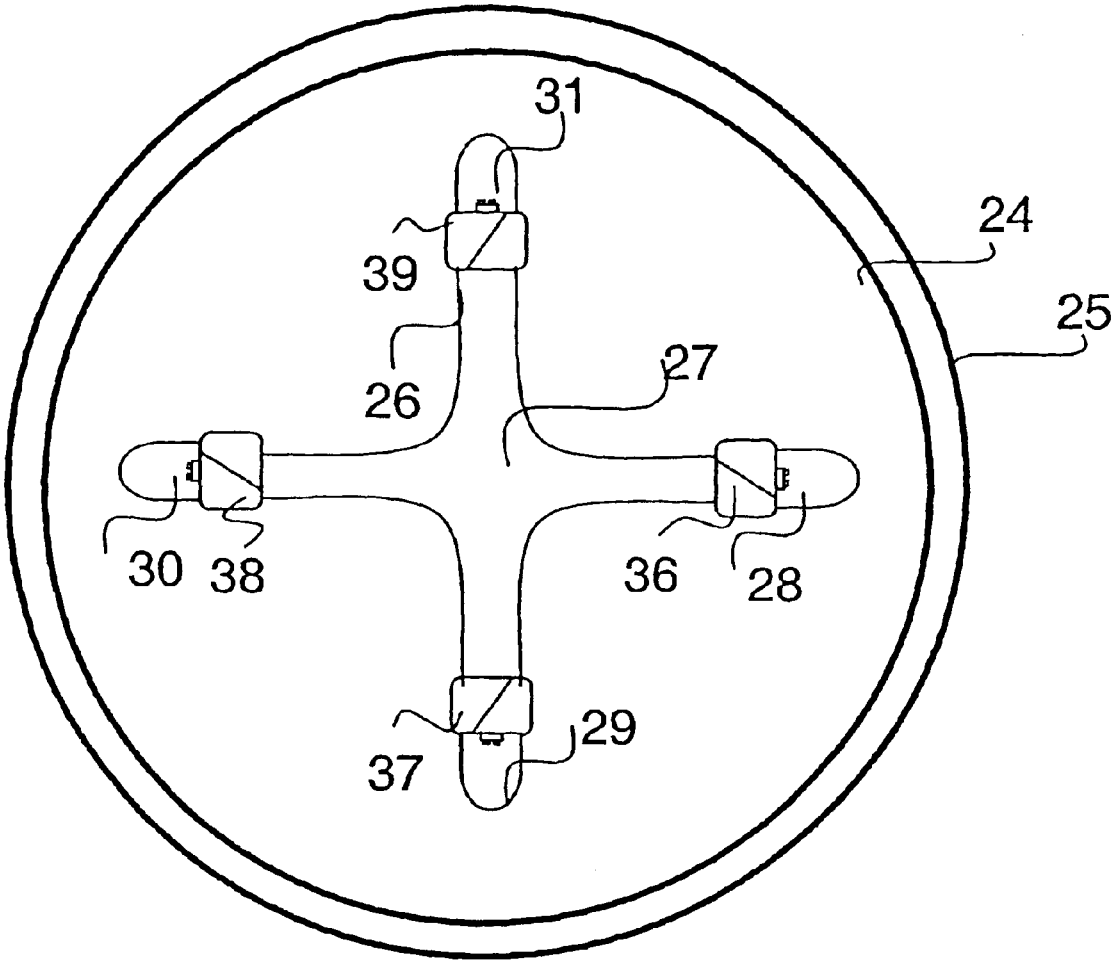
FIG. 5 is a top view of a cavity wall within a coaxial filter housing, the cavity wall being provided with an adjustable coupling iris.
Figure 6:
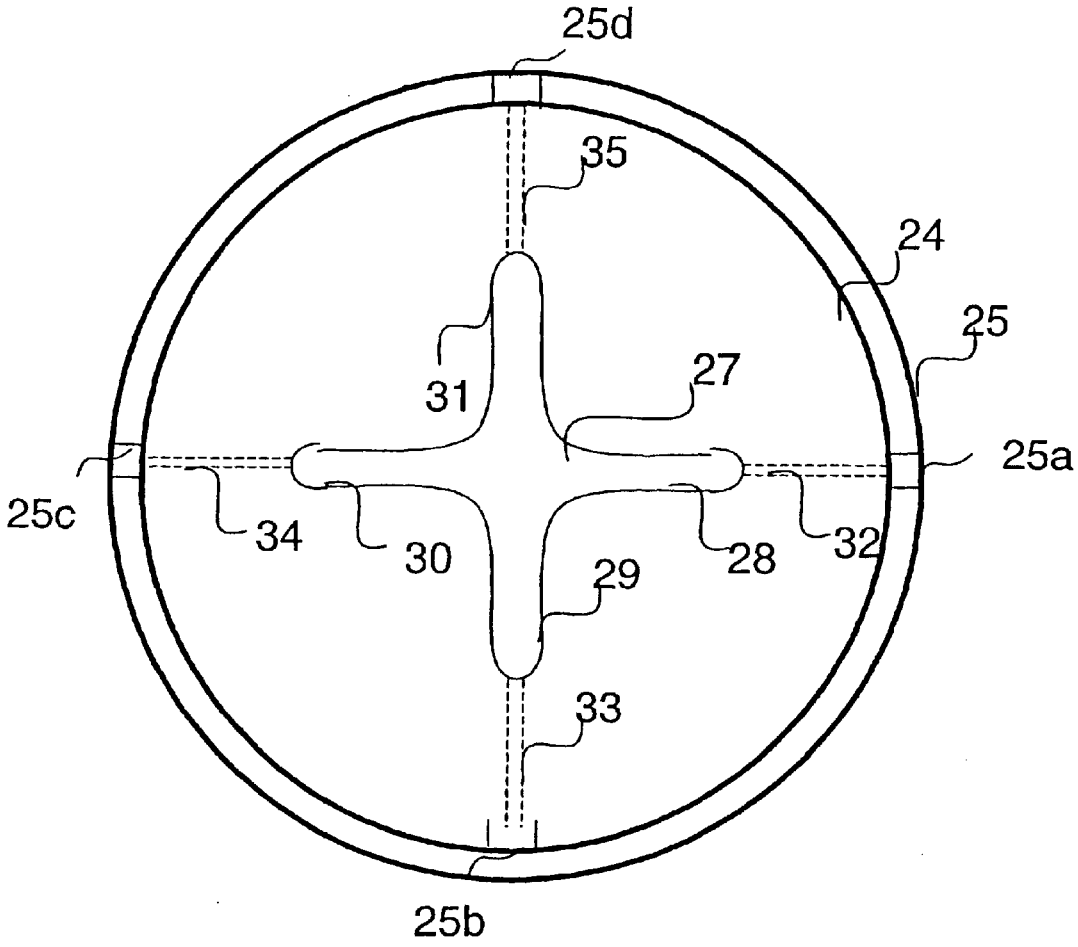
FIG. 6 is a top view of the cavity wall shown in FIG. 5, showing radial passageways connecting slits of the coupling iris to the filter housing exterior.
Figure 7:
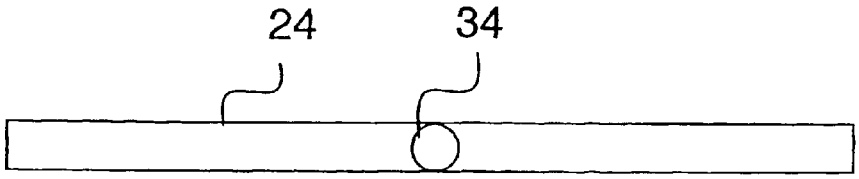
FIG. 7 is a side view of FIG. 6.

Referring to FIGS. 5 and 6, the adjustable coupling aperture arrangement comprises an electrically conductive wall 24 coaxially located within a filter housing 25. Wall 24 is provided with a cruciform iris 26 comprising a central zone 27 having four slits 28, 29, 30 and 31 extending outwardly therefrom. Each slit is connected by a radial passageway 32, 33, 34 and 35 to respective apertures 25*a*, 25*b*, 25*c* and 25*d* in the filter housing permitting access to the slits from the exterior of the filter housing. The passageways are within the boundary of the wall's opposite surfaces. In each slit is arranged a captive, movable, rectangular metal slug 36, 37, 38 and 39.

Referring to FIGS. 8–11, each rectangular slug comprises two sections A and B each in the form of general trapezoids whose respective non-parallel sides 40 and 41 interface. The two sections are held together by a screw 42. One section, A, is provided with a threaded hole (not shown), which cooperates with the screw's thread when the screw is disposed in a bore hole in section B. The screw is provided with a slotted bayonet head 43 which allows the screw to be engaged by a tool (not shown) having a T-shaped end to allow the screw to be rotated as well as allowing the associated slug to be moved linearly.

Figure 8:
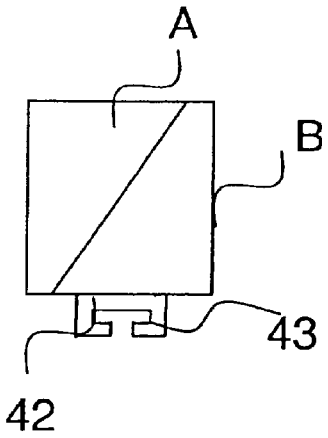
FIG. 8 is a top view of an expanded adjustment slug.
Figure 9:
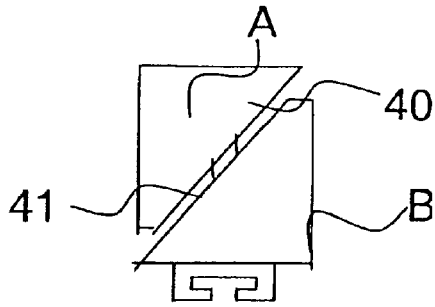
FIG. 9 is a top view of a contracted adjustment slug.
Figure 10:
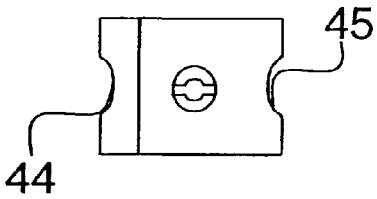
FIG. 10 is an end view of a adjustment slug.
Figure 11:
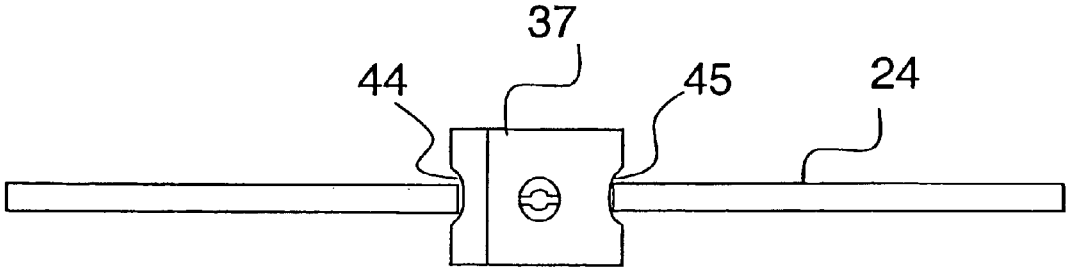
FIG. 11 is a side view of a cavity wall showing an adjustment slug located within a slit of the coupling iris.

A groove 44, 45 is provided in a side of each section A and B such that when a slug is assembled by screwing the sections together, opposite parallel grooves are formed for slidably engaging the edges of respective slits. Due to cooperation between sections A and B, the width between the sides provided with the grooves is maximum when the screw is tightened as shown in FIG. 8, and minimum when the screw is loosened as shown in FIG. 9. Referring to FIG. 11, the width is such that the slug is slidably retained in a slit when the screw is loosened, and fixedly grips and makes electrical contact with opposite edges of the slit when the screw is tightened, thereby affecting the electrical length of the slit.

In operation, slugs 36, 37, 38 and 39 are located in respective slits. Desired filter transmission and reflection characteristics are obtained, using a vector network analyser and manipulating the slugs with the tool inserted into respective passageways 32, 33, 34 and 35 via associated apertures 25*a*, 25*b*, 25*c* and 25*d*. While it is preferable to use four slugs to maintain symmetry in two principal planes, it will be understood that this is not an essential requirement.

Further, in filter arrangements where only a single slit is required, either one or two slugs could be used.

What is claimed is:

1. A waveguide directional filter arrangement comprising an input waveguide and an output waveguide connected by a cavity resonator comprising at least three stacked resonator elements, wherein at least one pair of non-adjacent resonator elements include an additional coupling to couple the non-adjacent resonator elements, wherein at least one said resonator element includes a plurality of cooling fins operatively attached thereto.

2. A waveguide directional filter arrangement comprising an input waveguide and output waveguide connected by a cavity resonator comprising at least three stacked resonator elements, said input waveguide and said output waveguide each include broad wall sections joined by narrow wall sections whose aspect ratio is greater than 2:1, each said waveguide includes an aperture arranged to couple its associated waveguide to said cavity resonator, wherein edges of each aperture include inwardly extending sections, wherein at least one pair of non-adjacent resonator elements includes an additional coupling to couple the non-adjacent resonator elements, said additional coupling comprising a first pair of coupling elements each of which extends into a respective non-adjacent resonator element, said coupling elements being connected together by a first external transmission line, and a second pair of coupling elements each of which extend into a respective non-adjacent resonator element, said coupling elements of said second pair of coupling elements being connected together by a second external transmission line, said first pair of coupling elements and said second pair of coupling elements being disposed in a pre-determined spaced relationship, wherein said first pair of coupling elements and said second pair of coupling elements are disposed at approximately 90° to each other.

3. In a microwave filter comprising a housing within which is disposed at least two cavity resonators coupled by aperture means in a substantially planar wall common to both said resonators, an adjustable coupling aperture arrangement including aperture means comprising at least one slit of predetermined dimensions, the at least one slit communicating with a respective access hole in said housing via an associated passageway that lies within the boundary of said wall's major surfaces, wherein said at least one slit is provided with a moveable metal slug that is slideably retained by opposite longitudinal edges of the slit, whereby said slug can be engaged and slideably manipulated by a tool means, introduced into said access hole and guided to said slug via said passageway, into a position in which electrical contact between said slug and said edges of the slit produces a desired change in effective electrical length of the slit.

4. An adjustable aperture arrangement as claimed in claim 3, wherein said slug includes a screw operated locking means arranged to be actuated by said tool means for locking said slug in said position.

5. An adjustable aperture arrangement as claimed in claim 4, wherein said slug is a rectangular-shaped block having a groove in each of two opposite parallel sides for cooperating with opposite edges of said slit for slideably retaining and gripping said block therein, said block being formed from a first trapezoid-shaped section and a second trapezoid-shaped section assembled together, with each section's non-parallel side interfacing, by a screw having a head and a threaded section, said screw's threaded section freely passing through a hole in the first trapezoid section to cooperate with a threaded hole provided in the second trapezoid-shaped section, whereby the width between said grooves can be varied by a turning adjustment of said screw with said tool means engaging the screw's head to change the positional relationship between the said interfacing non-parallel sides to cause the slug to be either slideably retained within the slit for manipulation, or fixedly locked in electrical contact with said edges of said slit.

6. An adjustable aperture arrangement as claimed in claim 5, wherein said aperture means comprises four slits of predetermined dimensions, extending outwardly from a central zone, each slit including a said slug, and each slit communicating with a respective said access hole via an associated said passageway.

7. An adjustable aperture arrangement as claimed in claim 6, wherein said planar wall is substantially circular in shape.

8. An adjustable aperture arrangement as claimed in claim 5, wherein the screw head includes a bayonet socket for cooperating with a tool having a T-shaped end.

9. A waveguide directional filter arrangement comprising input waveguide and an output waveguide connected by resonator structure, wherein said input waveguide and said output waveguide each include broad wall sections joined by narrow wall sections whose aspect ratio is greater than 2:1, and wherein said resonator structure comprises a housing having access holes, at least two cavity resonators coupled by an adjustable coupling aperture in a substantially planar wall common to both said resonators, said adjustable coupling aperture arrangement including at least one slit of predetermined dimensions, the at least one slit communicating with a respective access hole via an associated passageway that lies within the boundary of major surfaces of said planar wall, wherein said at least one slit is provided with a moveable metal slug that is slideably retained by opposite longitudinal edges of the slit, whereby said slug can be engaged and slideably manipulated by a tool, introduced into said access hole and guided to said slug via said passageway, into a position in which electrical contact between said slug and said edges of the slit produces a desired change in effective electrical length of the slit.

* * * * *